US009366172B2

(12) United States Patent
Whitt et al.

(10) Patent No.: US 9,366,172 B2
(45) Date of Patent: Jun. 14, 2016

(54) PARTICULATE FILTER DEVICE MONITORING SYSTEM FOR AN INTERNAL COMBUSTION ENGINE

(71) Applicant: GM Global Technology Operations LLC, Detroit, MI (US)

(72) Inventors: Christopher Whitt, Howell, MI (US); Douglas Christopher Sarsen, Howell, MI (US); Christopher C. Swoish, Lapeer, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 118 days.

(21) Appl. No.: 13/909,627

(22) Filed: Jun. 4, 2013

(65) Prior Publication Data

US 2014/0352281 A1 Dec. 4, 2014

(51) Int. Cl.

| | |
|---|---|
| ***F01N 3/00*** | (2006.01) |
| ***F01N 11/00*** | (2006.01) |
| ***F02D 41/02*** | (2006.01) |

(52) U.S. Cl.

CPC ..... *F01N 11/00* (2013.01); *F02D 41/029* (2013.01); *F02D 2200/0812* (2013.01); *F02D 2250/26* (2013.01)

(58) Field of Classification Search

CPC ..... F01N 11/00; F02D 41/029; F02D 2200/0812; F02D 2250/26

USPC ..... 60/274, 311

See application file for complete search history.

(56) References Cited

U.S. PATENT DOCUMENTS

| | | | | |
|---|---|---|---|---|
| 8,266,890 | B2 * | 9/2012 | Singh | 60/274 |
| 2011/0146246 | A1 * | 6/2011 | Farman et al. | 60/286 |

* cited by examiner

*Primary Examiner* — Audrey K Bradley
*Assistant Examiner* — Jason Sheppard
(74) *Attorney, Agent, or Firm* — Cantor Colburn LLP

(57) ABSTRACT

A particulate filter device monitoring system for an internal combustion engine includes a particulate accumulation register configured to store an amount of particulate in a particulate filter. The particulate accumulation register includes a particulate accumulation trigger zone having a power limiting mode trigger. A power limiting mode trigger module is configured to limit output power of the internal combustion engine when the amount of particulate accumulation reaches the power limiting mode trigger. A particulate accumulation model module includes a particulate accumulation model configured to calculate changes in particulate accumulation in the particulate accumulation register at a first sampling rate when particulate accumulation is outside the particulate accumulation trigger zone, and at a second sampling rate when particulate accumulation is within the particulate accumulation trigger zone.

10 Claims, 4 Drawing Sheets

PARTICULATE FILTER DEVICE MONITORING SYSTEM FOR AN INTERNAL COMBUSTION ENGINE

FIELD OF THE INVENTION

The subject invention relates to engine emission monitoring systems and, more particularly, to a particulate filter device monitoring system for an internal combustion engine.

BACKGROUND

Exhaust gas emitted from an internal combustion engine, particularly a diesel engine, is a heterogeneous mixture that contains gaseous emissions such as, but not limited to, carbon monoxide ("CO"), unburned hydrocarbons ("HC") and oxides of nitrogen ("$NO_x$"), as well as condensed phase materials (liquids and solids) that constitute particulate matter ("PM"). Catalyst compositions, typically disposed on catalyst supports or substrates, are provided in an engine exhaust system as part of an aftertreatment system to convert certain, or all of these exhaust constituents into non-regulated exhaust gas components.

One type of exhaust treatment technology for reducing emissions is a particulate filter ("PF"). The PF is designed to remove diesel particulate matter, or soot, from exhaust gas of an engine. The particulate matter removed from the exhaust is entrapped by, and entrained in, the PF. When accumulated soot reaches a predetermined level the PF is either replaced or regenerated. Replacement or regeneration facilitates that soot removal continues at desired parameters.

Many engines include a controller having a soot out model that predicts soot accumulation in the PF. The soot out monitor employs various engine operating parameters to predict soot accumulation levels in the PF. The operating parameters include duration and number of accelerations, duration of operation at constant RPM above idle, and idle time. Inaccurate soot accumulation predictions could lead to premature replacement or cleaning of a PF, or operating conditions in which soot is not removed at desired levels. Prediction inaccuracies tend to occur after prolonged periods of low speed operation. During lower speeds, accurate pressure change readings are difficult to obtain. Once normal highway speed is resumed, the controller may sense a sudden increase in a rate of soot accumulation. The sudden change in soot accumulation could cause the controller to force the engine into a reduced power mode which necessitates maintenance. Accordingly, it is desirable to provide a soot out model with the flexibility to adjust soot accumulation rates following low speed and idle operations.

SUMMARY OF THE INVENTION

In accordance with an exemplary embodiment, a particulate filter device monitoring system for an internal combustion engine includes a particulate accumulation register configured to store an amount of particulate in a particulate filter. The particulate accumulation register includes a particulate accumulation trigger zone having a power limiting mode trigger. A power limiting mode trigger module is configured to limit output power of the internal combustion engine when the amount of particulate accumulation reaches the power limiting mode trigger. A particulate accumulation model module includes a particulate accumulation model configured to calculate changes in particulate accumulation in the particulate accumulation register at a first sampling rate when particulate accumulation is outside the particulate accumulation trigger zone, and at a second sampling rate when particulate accumulation is within the particulate accumulation trigger zone.

In accordance with another exemplary embodiment, an internal combustion engine includes an internal combustion engine including an exhaust gas conduit, a particulate filter device fluidically connected to the exhaust gas conduit, and a particulate filter device monitoring system having a control module configured to monitor particulate accumulation in the particulate filter device. The control module includes a particulate accumulation register configured to store an amount of particulate in a particulate filter. The particulate accumulation register includes a particulate accumulation trigger zone having a power limiting mode trigger. A power limiting mode trigger module is configured to limit output power of the internal combustion engine when the amount of particulate accumulation reaches the power limiting mode trigger. A particulate accumulation model module includes a particulate accumulation model configured to calculate changes in particulate accumulation in the particulate accumulation register at a first sampling rate when particulate accumulation is outside the particulate accumulation trigger zone and at a second sampling rate when particulate accumulation is within the particulate accumulation trigger zone.

In accordance with yet another exemplary embodiment, a method of monitoring a particulate filter of an internal combustion engine includes calculating an amount of particulate in a particulate filter device, determining whether the amount of particulate is within a particulate trigger zone, calculating a rate of increase of the particulate in the particulate filter device at a first sampling rate if the amount of particulate is outside the particulate accumulation trigger zone, and calculating the rate of increase of particulate at a second sampling rate, that is lower than the first sampling rate, if the amount of particulate is within the particulate accumulation trigger zone.

The above features and advantages and other features and advantages of the invention are readily apparent from the following detailed description of the invention when taken in connection with the accompanying drawings.

BRIEF DESCRIPTION OF THE DRAWINGS

Other features, advantages and details appear, by way of example only, in the following detailed description of embodiments, the detailed description referring to the drawings in which.

DESCRIPTION OF THE EMBODIMENTS

Figure 1:
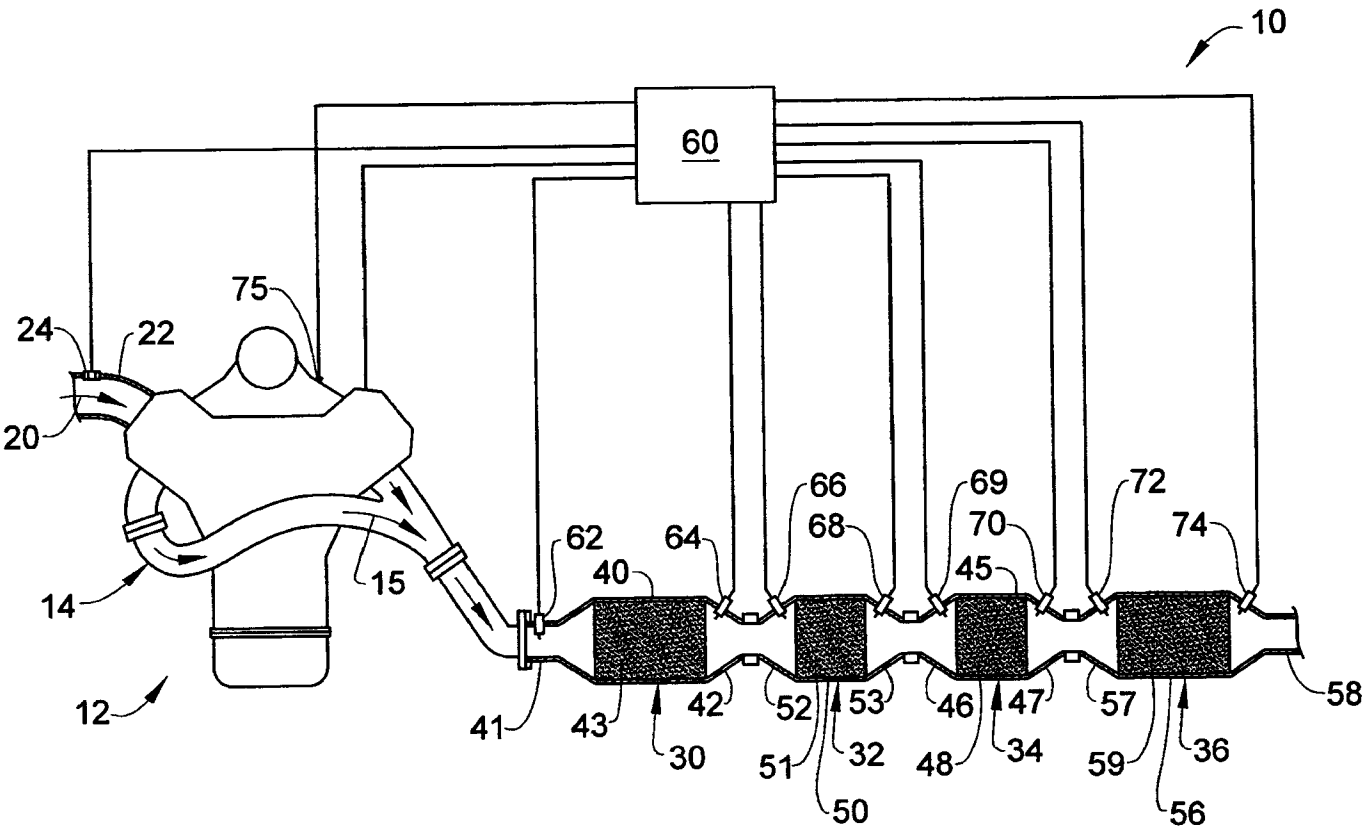
FIG. 1 is a schematic diagram of a particulate filter device monitoring system including a control module in accordance with exemplary embodiments.

The following description is merely exemplary in nature and is not intended to limit the present disclosure, its application or uses. It should be understood that throughout the drawings, corresponding reference numerals indicate like or corresponding parts and features. As used herein, the term "module" refers to an application specific integrated circuit (ASIC), an electronic circuit, a processor (shared, dedicated, or group) and memory that executes one or more software or firmware programs, and/or a combinational logic circuit, When implemented in software, a module can be embodied in memory as a non-transitory machine-readable storage medium readable by a processing circuit and storing instructions for execution by the processing circuit for performing a method.

Referring now to FIG. 1, an exemplary embodiment is directed to a particulate filter device monitoring system 10 for an internal combustion ("IC") engine 12. IC engine 12 may be a diesel engine or a gas engine. An exhaust gas conduit 14, which may comprise several segments, transports exhaust gas 15 from the engine 12 to various aftertreatment devices. More specifically, engine 12 is configured to receive an intake air 20 through an air intake passage 22. Intake air passage 22 includes an intake mass airflow sensor 24 for determining the intake air mass of the engine 12. In accordance with an aspect of an exemplary embodiment, intake mass airflow sensor 24 may take the form of a vane meter. In accordance with another aspect of the exemplary embodiment, intake mass airflow sensor 24 may take the form of a hot wire type intake mass airflow sensor. It should be understood that other types of sensors may also be used. Intake air 20 mixes with fuel (not shown) to form a combustible mixture. The combustible mixture is compressed to combustion pressure in a combustion chamber of engine 12 producing work, (i.e., engine output and exhaust gases 15). Exhaust gases 15 pass from the engine 12 to various aftertreatment devices of the particulate filter device monitoring system 10 as will be detailed more fully below.

In the exemplary embodiment as illustrated, aftertreatment devices of particulate filter device monitoring system 10 include a first oxidation catalyst ("OC") device 30, a selective catalytic reduction ("SCR") device 32, a second OC device 34, and a particulate filter ("PF") device 36. As can be appreciated, particulate filter device monitoring system 10, of the present disclosure, may include various combinations of one or more of the aftertreatment devices shown in FIG. 1, and/or other aftertreatment devices (e.g., lean $NO_x$ traps), and is not limited to the present example.

First OC device 30 includes a casing 40 having an inlet 41 in fluid communication with exhaust gas conduit 14 and an outlet 42. Casing 40 may surround a flow-through metal or ceramic monolith substrate 43. Similarly, second OC device 34 includes a casing 45 having an inlet 46 and an outlet 47. Casing 45 may surround a flow-through metal or ceramic monolith substrate 48. Flow-through metal or ceramic monolith substrate 43, and/or 48 may include an oxidation catalyst compound disposed thereon. The oxidation catalyst compound may be applied as a wash coat and may contain platinum group metals such as platinum ("Pt"), palladium ("Pd"), rhodium ("Rh") or other suitable oxidizing catalysts, or combinations thereof. The OC devices 30 and 34 are useful in treating unburned gaseous HC and CO, which are oxidized to form carbon dioxide and water.

SCR device 32 may be disposed downstream of first OC device 30 and upstream of second OC device 34. In a manner similar to first and second OC devices 30 and 34, SCR device 32 includes a casing 50 that houses a flow-through ceramic or metal monolith substrate 51. Casing 50 includes an inlet 52 in fluid communication with outlet 42 of first OC device 30, and an outlet 53 in fluid communication with inlet 46 of second OC device 34. Substrate 51 may include a SCR catalyst composition applied thereto. The SCR catalyst composition may contain a zeolite and one or more base metal components such as iron ("Fe"), cobalt ("Co"), copper ("Cu") or vanadium ("V") which can operate efficiently to convert NOx constituents in the exhaust gas 15 in the presence of a reductant such as ammonia.

PF device 36 may be disposed downstream of SCR device 32 and the second OC device 34. PF device 36 operates to filter exhaust gas 15 of carbon and other particulates (soot). PF device 36 includes a casing 56 having an inlet 57 fluidically coupled to outlet 47 of second OC device 34, and an outlet 58 that may discharge to ambient. Casing 56 may surround a ceramic wall flow monolith particulate filter 59. Ceramic wall flow monolith particulate filter 59 may have a plurality of longitudinally extending passages (not separately labeled) that are defined by longitudinally extending walls (also not separately labeled). The passages include a subset of inlet passages that have an open inlet end and a closed outlet end, and a subset of outlet passages that have a closed inlet end and an open outlet end. Exhaust gas 15 entering ceramic wall flow monolith particulate filter 59 through the inlet ends of the inlet passages is forced to migrate through adjacent longitudinally extending walls to the outlet passages. It is through this wall flow mechanism exhaust gas 15 is filtered of carbon and other particulates. The filtered particulates are deposited on the longitudinally extending walls of the inlet passages and, over time, will have the effect of increasing exhaust gas 15 backpressure experienced by the engine 12. It is appreciated, that ceramic wall flow monolith particulate filter 59 is merely exemplary in nature and that the PF device 36 may include other particulate filter devices such as, wound or packed fiber filters, open cell foams, sintered metal fibers, etc. The increase in exhaust gas 15 backpressure caused by the accumulation of particulate matter in ceramic wall flow monolith particulate filter 59 typically requires that the PF device 36 is periodically replaced, cleaned, or regenerated. Regeneration involves the oxidation or burning of the accumulated carbon and other particulates in what is typically a high temperature environment (>600° C.).

A control module 60 is operably connected to, and monitors, engine 12 and the particulate filter device monitoring system 10 through a number of sensors. FIG. 1 illustrates control module 60 in communication with the engine 12, intake mass airflow sensor 24, first and second temperature sensors 62 and 64 for determining the temperature profile of the first OC device 30, third and fourth temperature sensors 66 and 68 for determining the temperature profile of the SCR device 32, fifth and sixth temperature sensors 69 and 70 for determining the temperature profile of the second OC device 34, and seventh and eighth temperature sensors 72 and 74 for determining the temperature profile of the PF device 36, and a tachometer 75 for determining engine speed and engine accelerations.

The control module 60 determines, in part, an amount of particulate matter, or soot accumulation, in PF device 36. Soot accumulation in PF device 36 leads to an increase in exhaust gas backpressure on engine 12. The increase in exhaust gas backpressure caused by the accumulation of soot in ceramic wall flow monolith particulate filter 59 typically requires that the PF device 36 is periodically replaced, cleaned, or regenerated. Regeneration involves the oxidation or burning of the accumulated carbon and other particulates in what is typically a high temperature environment (>600° C.).

In accordance with one exemplary aspect of the invention, control module 60 includes logic that monitors operating parameters of engine 12 including temperatures, accelerations, and exhaust mass flow. Exhaust mass flow is based on the intake air mass of the engine 12, which is measured by the intake air mass airflow sensor 24, as well as a fuel mass flow of the engine 12. Specifically, the exhaust mass flow is calculated by adding the intake air mass of the engine 12 and the fuel mass flow of the engine 12. Based on the monitored parameters, control module 60 calculates an amount of particulate accumulation and a rate of change of particulate accumulation in PF device 36.

Figure 2:
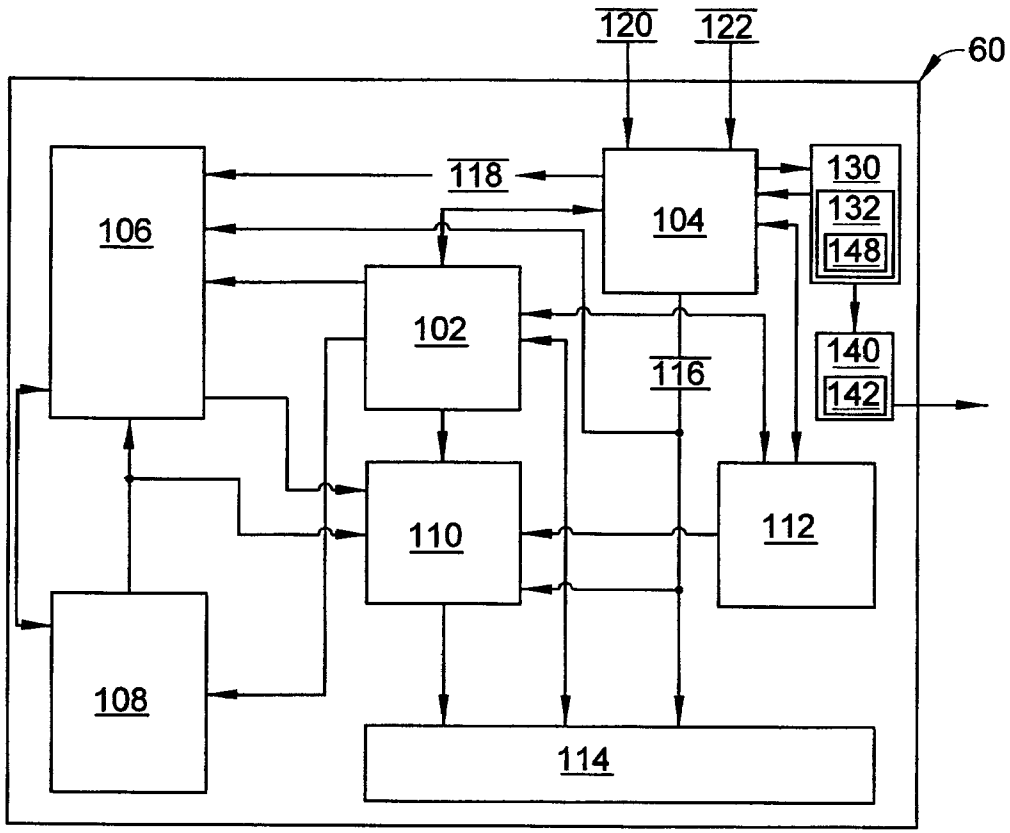
FIG. 2 is a dataflow diagram of the control module shown in FIG. 1 in accordance with exemplary embodiments.

FIG. 2 is an illustration of a dataflow diagram that illustrates various elements that may be embedded within the control module 60. Various embodiments of the particulate filter device monitoring system 10 of FIG. 1, according to the present disclosure, may include any number of sub-modules embedded within the control module 60. As can be appreciated, the sub-modules, shown in FIG. 2, may be combined or further partitioned as well. Inputs to control module 60 may be sensed from the particulate filter device monitoring system 10, received from other control modules (not shown), or determined by other sub-modules or modules. In the embodiment, as shown in FIG. 2, control module 60 includes a memory 102, a regeneration control module 104, a regeneration mode trigger module 106, a soot accumulation counter module 108, an idle time counter module 110, an interrupt module 112, and a fuel injection control module 114. Control module 60 also includes a regeneration mode switch 116 and a particulate or soot accumulation register 118.

In one embodiment, the memory 102 of the control module 60 stores a number of configurable limits, maps, and variables that are used to calculate soot accumulation and control regeneration of PF device 36 of FIG. 1. Each of the modules 104-114 interfaces with the memory 102 to retrieve and update stored values as needed. For example, the memory 102 can provide values to the regeneration control module 104 for supporting determination of a soot load in soot accumulation register 118, and thresholds for activating regeneration mode trigger 106 based on vehicle operating conditions 120 and exhaust conditions 122.

The regeneration control module 104 may apply algorithms known in the art to determine when to set a regeneration mode switch 116 to activate regeneration mode trigger module 106 when an amount of particulate in PF device 36 of FIG. 1 reaches a particular threshold value. For example, the regeneration mode switch 116 may be set when the soot load in soot accumulation register 118 exceeds a threshold defined in the memory 102. Regeneration of the PF device 36 of FIG. 1 can be based on, or limited, according to a particulate accumulation model module 130 connected to regeneration control module 104. Regeneration control module 104 compares vehicle operating conditions 120 and exhaust conditions 122 with a particulate accumulation model 132 provided in particulate accumulation model module 130 to calculate soot accumulation and a rate of change of soot accumulation in PF device 36, and determine when a regeneration cycle is indicated. The vehicle operating conditions 120 and the exhaust conditions 122 can be provided by sensors or other modules. For example, the seventh and eighth temperature sensors 72, 74 (shown in FIG. 1) send electrical signals to the control module 60, of FIG. 1, to indicate a temperature profile of the PF device 36 of FIG. 1. Factors such as engine speed, exhaust temperature, time elapsed since a last regeneration, distance traveled since a last regeneration, fuel consumed since a last regeneration, and a modeled soot level can also be used to determine when the regeneration mode switch 116 should be set. In addition, particulate accumulation model module 130 can set a reduced power mode when accumulated particulate reaches or exceeds a predetermined value.

In accordance with an exemplary embodiment, control module 60 includes a power limiting mode trigger module 140 operatively connected to particulate accumulation model module 130. Power limiting control module 140 includes a power limiting mode trigger 142 that signals an engine controller (not shown) to reduce power output of engine 12 until a maintenance action is taken to reduce the amount of particulate in ceramic wall flow monolith particulate filter 59. Power limiting mode trigger 142 represents a particular amount of particulate stored in soot accumulation register 118. When operating at low speeds, such as idle, for a prolonged period, particulate accumulation model 132 does not calculate particulate accumulation. Thus, when transitioning from low speed operation to highway speed operation, particulate accumulation model module 130 may detect a sudden change in particulate accumulation and prematurely signal power limiting mode trigger module 140 to initiate power limiting mode trigger 142 before regeneration is enabled. In order to reduce the need for premature maintenance cycles, particulate accumulation model module 130 includes a sampling rate limiting model 148 that changes a sampling rate of particulate accumulation during select periods.

Figure 3:
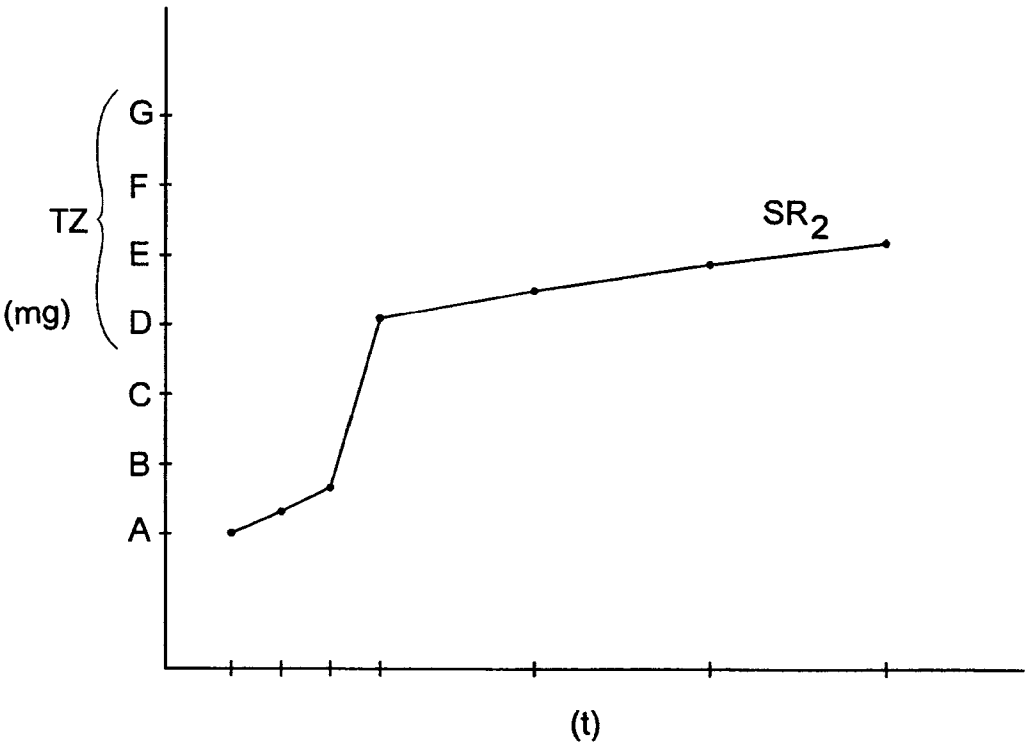
FIG. 3 is a graph depicting a particulate accumulation trigger zone in accordance with an exemplary embodiment.

Sampling rate model 148 includes a particulate accumulation trigger zone that defines a set of particulate accumulation values and power limiting mode trigger 142 as shown in FIG. 3. In FIG. 3, the particulate accumulation trigger zone spans values D, E, F and G with value G representing the power limiting mode trigger 142. When particulate accumulation, in soot accumulation register 118, is outside (above or below) the particulate accumulation trigger zone, particulate accumulation model module 130 signals sampling rate model 148 to sample particulate accumulation at a first sampling rate ($SR_1$). However, when particulate accumulation is within the particulate accumulation trigger zone, particulate accumulation model module 130 triggers sampling rate model to sample particulate accumulation at a second, reduced rate ($SR_2$). In accordance with one aspect of the exemplary embodiment, $SR_1$ may be 1000 g/sec and $SR_2$ is less than $SR_1$. $SR_1$ may be an order of magnitude greater than $SR_2$. For example, $SR_2$ could be 10 g/sec. The change, e.g., reduction in sampling rate, provides time for corrective action. For example, when the amount of particulate in particulate accumulation register 118 enters the particulate accumulation trigger zone, particulate accumulation model module 130 signals regeneration control module 104 to begin a regeneration cycle of ceramic wall flow monolith particulate filter 59. The reduction in sampling rate provides time for regeneration to lower the amount of particulate in ceramic wall flow monolith particulate filter 59 and reduce instances of premature power limiting.

Figure 4:
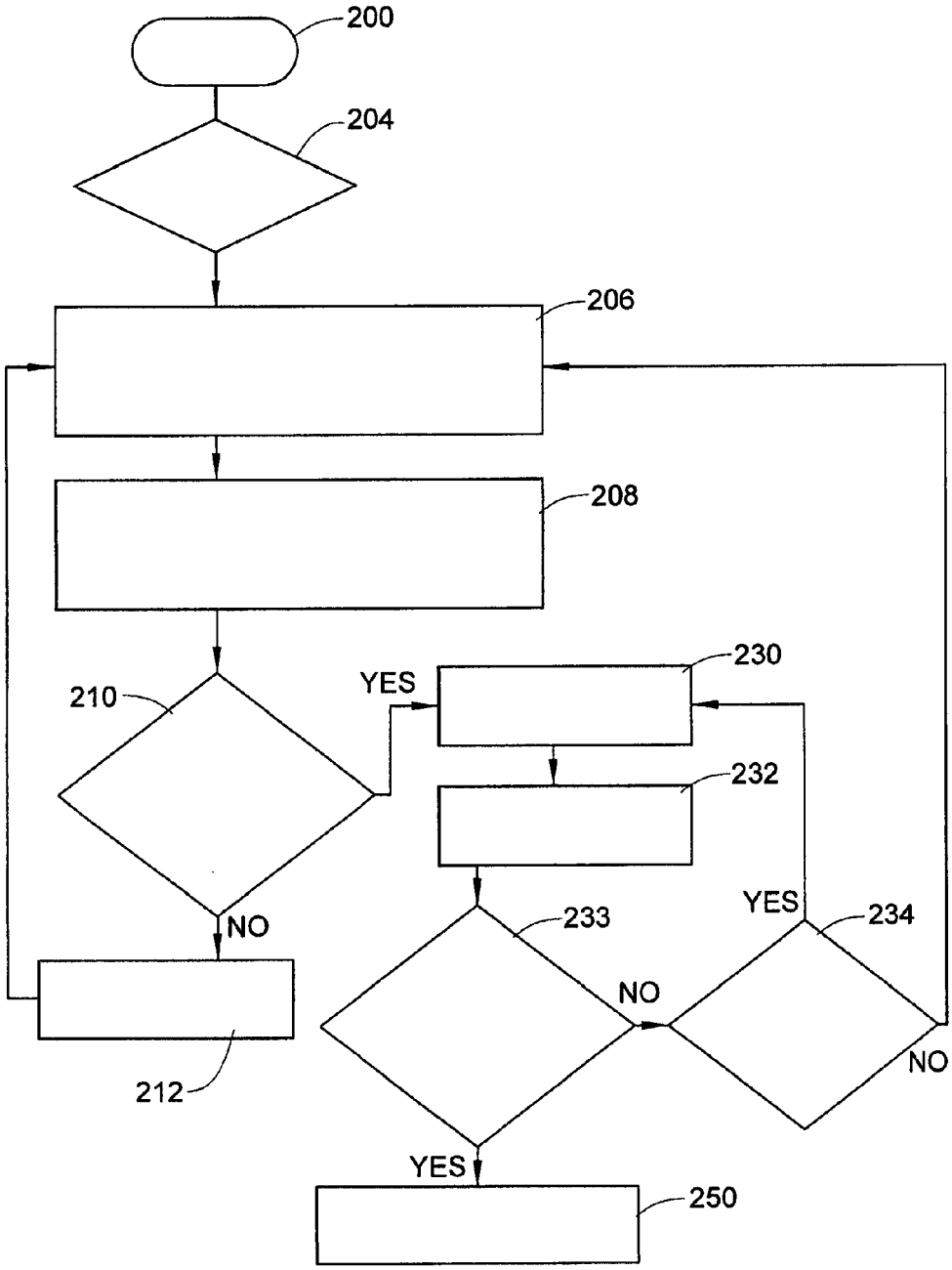
FIG. 4. is a flowchart depicting a method of monitoring a particulate filter of an internal combustion engine.

Turning to FIG. 4, and with continued reference to FIGS. 1, 2 and 3, a flowchart illustrates a method for monitoring particulate or soot accumulation in PF device 36, of FIG. 1, that can be performed by the control module 60 of FIG. 1 in accordance with the present disclosure. As can be appreciated in light of the disclosure, the order of operation within the method is not limited to the sequential execution as illustrated in FIG. 4, but may be performed in one or more varying orders as applicable and in accordance with the present disclosure. It should also be appreciated that in various embodiments, the method can be scheduled to run based on predetermined events, and/or run continually during operation of the engine 12 of FIG. 1.

In one example, the method may begin at block 200. At block 204, control module 60 of FIG. 1 determines whether engine 12 of FIG. 1 is operating. If engine 12 is operating, at block 206 control module 60 determines an amount of particulate within PF device 36 of FIG. 1. In block 208, the amount of particulate within PF device 36 is stored in particulate accumulation register 118 of FIG. 2. In block 210, control module 60 determines whether the amount of particulate in particulate accumulation register 118 is within a particulate trigger zone of FIG. 3. If the amount of particulate in particulate accumulation register 118 is not within the particulate accumulation trigger zone, particulate accumulation model module 130 samples particulate accumulation at $SR_1$ of FIG. 3 in block 212.

If the amount of particulate is within the particulate accumulation trigger zone of FIG. 3, particulate accumulation model module 130 samples particulate accumulation at $SR_2$ of FIG. 3 in block 230. In block 232, control module 60 activates regeneration control module 104 to begin regeneration of PF device 36. After starting regeneration, particulate accumulation model module 130 determines if the amount of particulate in particulate accumulation register 118 remains, or has reached, the low power trigger in block 233. If the low power trigger has been reached, control module 60 activates power limiting module 140 to reduce power output of engine 12, in block 250. If the power limiting mode trigger 142 has not been reached, particulate accumulation module determines, in block 234, whether the particulate within particulate accumulation register 118 remains in the particulate accumulation trigger zone. If the amount of particulate within particulate accumulation register 118 remains in the particulate accumulation trigger zone, particulate accumulation model module 130 continues to sample at $SR_2$, in block 230. If the amount of particulate within particulate accumulation register 118 is no longer in the particulate accumulation trigger zone, control module 60 returns to block 206.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the application.

What is claimed is:

1. An internal combustion engine system comprising:

an internal combustion engine including an exhaust gas conduit;

a particulate filter device fluidically connected to the exhaust gas conduit; and a particulate filter device monitoring system having a control module configured to monitor particulate accumulation in the particulate filter device, the control module comprising:

a particulate accumulation register configured to store an amount of particulate in a particulate filter, the particulate accumulation register including a particulate accumulation trigger zone having a power limiting mode trigger;

a power limiting mode trigger module configured to limit output power of the internal combustion engine when the amount of particulate accumulation reaches the power limiting mode trigger; and a particulate accumulation model module including a particulate accumulation model configured to calculate changes in particulate accumulation in the particulate accumulation register at a first sampling rate when particulate accumulation is outside the particulate accumulation trigger zone and at a second sampling rate when particulate accumulation is within the particulate accumulation trigger zone, wherein the particulate filter device monitoring system reduces power output of the internal combustion engine when the amount of particulate accumulation reaches the power limiting mode trigger.

2. The internal combustion engine system according to claim 1, wherein the first sampling rate is higher than the second sampling rate.

3. The internal combustion engine system according to claim 1, wherein the first sampling rate is at least an order of magnitude greater than the second sampling rate.

4. The internal combustion engine system according to claim 1, wherein particulate accumulation model samples particulate accumulation at a rate of 1000 g/sec when particulate accumulation is outside the particulate accumulation trigger zone and at a rate of 10 g/sec when the particulate accumulation is within the particulate accumulation zone.

5. The internal combustion engine system according to claim 1, further comprising: a regeneration mode switch configured to initiate a regeneration mode when particulate accumulation is within the particulate accumulation trigger zone.

6. The internal combustion engine system according to claim 1, wherein the particulate accumulation model is configured to calculate changes in soot accumulation in the particulate filter.

7. A method of monitoring a particulate filter of an internal combustion engine, the method comprising:

operating the internal combustion engine;

accumulating particulate in the particulate filter;

calculating an amount of particulate in a particulate filter device;

determining whether the amount of particulate is within a particulate trigger zone;

calculating a rate of increase of the particulate in the particulate filter device at a first sampling rate if the amount of particulate is outside the particulate accumulation trigger zone; and calculating the rate of increase of particulate at a second sampling rate, that is lower than the first sampling rate if the amount of particulate is within the particulate accumulation trigger zone;

triggering a power limiting mode trigger module to limit output power of the internal combustion engine if the particulate accumulation reaches a power limiting mode trigger of the particulate trigger zone; and operating the internal combustion engine in a limited output power mode once the particulate accumulation reaches the power limiting mode trigger.

8. The method of claim 7, wherein calculating the rate of increase at the second sampling rate includes employing a sampling rate that is at least an order of magnitude lower than the first sampling rate.

9. The method of claim 7, further comprising, initiating a regeneration mode to regenerate the particulate filter when the amount of particulate is within the particulate accumulation trigger zone.

10. The method of claim 7, wherein calculating the rate of increase of the particulate in the particulate filter device includes calculating a rate of increase of soot in the particulate filter.

* * * * *